US008006506B2

(12) United States Patent
Park

(10) Patent No.: US 8,006,506 B2
(45) Date of Patent: Aug. 30, 2011

(54) HIGH SPEED DEFROSTING HEAT PUMP

(75) Inventor: Choon-Kyoung Park, Seoul (KR)

(73) Assignee: Kohvac Co., Ltd, Seoul (KR)

( * ) Notice: Subject to any disclaimer, the term of this patent is extended or adjusted under 35 U.S.C. 154(b) by 508 days.

(21) Appl. No.: 12/296,727

(22) PCT Filed: Apr. 13, 2007

(86) PCT No.: PCT/KR2007/001810

§ 371 (c)(1),
(2), (4) Date: Oct. 10, 2008

(87) PCT Pub. No.: WO2007/119980

PCT Pub. Date: Oct. 25, 2007

(65) Prior Publication Data

US 2009/0277207 A1 Nov. 12, 2009

(30) Foreign Application Priority Data

Apr. 13, 2006 (KR) ..... 10-2006-0033676

(51) Int. Cl.
*F25D 21/06* (2006.01)

(52) U.S. Cl. ..... 62/151; 62/234; 62/324.1; 62/324.6

(58) Field of Classification Search ..... 62/324.1, 62/324.6, 151, 197, 234
See application file for complete search history.

(56) References Cited

U.S. PATENT DOCUMENTS

| | | | | |
|---|---|---|---|---|
| 4,055,963 | A * | 11/1977 | Shoji et al. | 62/238.6 |
| 2004/0000399 | A1 * | 1/2004 | Gavula | 165/299 |
| 2004/0134205 | A1 * | 7/2004 | Park et al. | 62/151 |
| 2005/0039878 | A1 * | 2/2005 | Meyer et al. | 165/42 |
| 2005/0044861 | A1 * | 3/2005 | Cho | 62/81 |
| 2006/0037344 | A1 * | 2/2006 | Cho et al. | 62/323.1 |
| 2006/0086496 | A1 * | 4/2006 | Gavula | 165/299 |

FOREIGN PATENT DOCUMENTS

| | | | |
|---|---|---|---|
| JP | 10-071850 | A | 3/1998 |
| KR | 10-1998-073107 | A | 11/1998 |
| KR | 10-2000-074465 | A | 12/2000 |

* cited by examiner

*Primary Examiner* — Mohammad Ali
(74) *Attorney, Agent, or Firm* — Sughrue Mion, PLLC

(57) ABSTRACT

Disclosed is a high speed defrosting heat pump having a closed refrigerant circulation loop including a four-way valve so as to conduct cooling and heating operations by switching a refrigerant-circulating direction by means of the four-way valve. A three-way valve is disposed on a refrigerant pipe connected between a compressor and the four-way valve, and a bypass pipe is branched off from the three-way valve in such a manner as to be connected to a refrigerant pipe connected between an expansion valve and a exterior heat exchanger, such that the hot gas discharged from the compressor is introduced to the exterior heat exchanger via the bypass tube by the control of the three-way valve.

6 Claims, 3 Drawing Sheets

HIGH SPEED DEFROSTING HEAT PUMP

This is a National Stage application under 35 U.S.C. §371 of PCT/KR2007/001810 filed on Apr. 13, 2007 which claims priority from Korean patent application 10-2006-0033676 filed on Apr. 13, 2006, all of which are incorporated herein by reference.

TECHNICAL FIELD

The present invention relates to a high speed and high efficiency defrosting heat pump mounted with a high speed defrosting device, in which a closed loop is formed by a compressor, a four-way valve, an interior heat exchanger, expansion valves, and an exterior heat exchanger, thereby performing cooling and heating operations by switching the refrigerant-circulating direction by means of the four-way valve.

BACKGROUND ART

Generally, a refrigerant-circulating cycle when a heat pump is used for heating has a closed loop formed by a compressor adapted to compress a refrigerant to high temperature and high pressure, a condenser adapted to condense the high temperature and high pressure refrigerant discharged from the compressor to a liquid phase by radiation at the indoor, expansion valves adapted to expand the liquid-phase refrigerant discharged from the condenser to a low pressure by means of a throttling action, and an evaporator adapted to evaporate the throttled refrigerant to a gaseous phase by means of the heat absorption at the outdoor.

Further, as is well known, the heat pump can be used for cooling when the refrigerant-circulating cycle is reversely operated, and therefore, the heat pump as a single device using a four-way valve, can selectively perform cooling and heating operations, thereby effectively utilizing a restricted space. Recently, thus, the heat pump becomes very popular in this field.

According to the heat pump, however, the surface temperature of an exterior heat exchanger serving as an evaporator during the heating operation in winter seasons is set lower than a dew-point temperature of outdoor air, such that frost is generated on the surface of the exterior heat exchanger. If the frost is accumulated, air-flowing is not good to cause the heat-exchanging between the outdoor air and the refrigerant to be made badly, thereby deteriorating the performance of the heat pump.

Moreover, as the specific volume of the refrigerant absorbed at the compressor based upon the decrease of an evaporation pressure becomes large, the compression efficiency becomes low and the discharge temperature is excessively increased, thereby causing the damage on the compressor.

To prevent such problems, therefore, a defrosting operation should be conducted under a given condition or for a given time. Thus, a hot gas bypass defrosting operation has been presented in conventional practices.

FIG. 1 shows the conventional heat pump using the hot gas bypass defrosting operation (as disclosed in Korean Utility Model Registration No. 20-0284796), and an explanation of the schematic configuration of the heat pump will be given below.

As shown, a discharge line of a compressor 11 is connected to an interior heat exchanger 12 as a condenser via a four-way valve 21, and an outlet of the condenser 12 from which the refrigerant is discharged is connected to an exterior heat exchanger 13. An outlet of the exterior heat exchanger 13 is connected to an inlet of the compressor 11 to which the refrigerant is supplied.

Between the interior heat exchanger 12 and the exterior heat exchanger 13 is provided an expansion valve 4 that is adapted to expand the liquid-phase refrigerant of high temperature and high pressure discharged from the interior heat exchanger 12 to a low pressure by means of a throttling action, so as to make the refrigerant easily evaporated, and a liquid receiver 43 is disposed at an inlet of the expansion valve 4, for supplying only the liquid-phase refrigerant to the expansion valve 4.

So as to conduct the defrosting operation, a bypass pipe 31 is connected at one end thereof between the output of the compressor 11 and the four-way valve 21 and is connected at the other end thereof between the exterior heat exchanger 13 and the expansion valve 4, while being controlled by means of a hot gas control valve 3. Further, a control valve 1 is disposed between the four-way valve 21 and the interior heat exchanger 12, and a control valve 2 is disposed between the liquid receiver 43 and the expansion valve 4, the control valves 1 and 2 serving as a structure for opening and closing the refrigerant pipe.

Referring to the defrosting operation of the cycle as mentioned above, if the defrosting operation is conducted for a given period of time at a state where the control valves 1 and 2 at the interior heat exchanger 12 are closed and the hot gas control valve 3 is opened, the high-temperature and high-pressure hot gas is introduced to the exterior heat exchanger 13 to cause the temperature at the exterior heat exchanger 13 to become raised, such that the frost or ice generated on the outside of the exterior heat exchanger 13 becomes removed. After completing the defrosting operation, a normal operation starts at a state where the control valves 1 and 2 are opened and the hot gas control valve 3 is closed, thereby returning to a normal heat pump cycle.

By the way, the hot gas bypass defrosting cycle of the conventional heat pump has had the following problems.

First, according to the conventional heat pump having the hot gas bypass defrosting cycle, the liquid-phase refrigerant that is not completely evaporated remain somewhat in the interior of the exterior heat exchanger 13, that is, at the inside of the evaporator, during the heating operation, such that they are accumulated in the lower tubes of the evaporator by its weight up to about 20% of the volume of the evaporator tube.

According to the conventional heat pump having the hot gas bypass defrosting cycle, moreover, the hot gas is introduced to the evaporator by using a single pipe, and in this case, even though the hot gas discharged from the compressor is bypassed up to a quantity of 100% to the evaporator, the liquid-phase refrigerant that is accumulated in the lower tubes of the evaporator are a little evaporated only on the top portion contacted with the hot gas, such that the refrigerant accumulated at the lower side that is not in contact with the hot gas still remain at the liquid phase. As a result, the hot gas is heat-exchanged with the refrigerant accumulated only on a portion of the evaporator tubes and is then circulated again to the compressor.

In general cases, during the defrosting operation the hot gas that is circulated again to the compressor 11 from the evaporator 13 is sufficiently heat-exchanged with the refrigerant remaining in the evaporator 13, such that it should be lowered at its temperature and pressure.

As mentioned above, however, since the high-temperature and high-pressure hot gas that has been bypassed up to a quantity of 100% to the evaporator is heat-exchanged with the refrigerant accumulated only on a portion of the evaporator tubes, the heat-exchanging operation is not completely conducted, thereby undesirably preventing the temperature and pressure of the hot gas from being sufficiently decreased.

The hot gas that is circulated again from the evaporator to the compressor exceeds an appropriate pressure, and thus, if it is recompressed by means of the compressor 11, an excessively high pressure is generated to apply an impact to the compressor, thereby making the compressor malfunctioned.

Therefore, according to the conventional heat pump having the hot gas bypass defrosting cycle, theoretically, the high-temperature and high-pressure hot gas is bypassed up to a quantity of 100% to the evaporator, but actually, the hot gas is bypassed up to only a quantity in a range between 20% and 30% to the evaporator when considering its stable operation, which of course accompanies a defect that the defrosting efficiency is substantially decreased.

Second, since the hot gas is bypassed up to only a quantity in a range between 20% and 30% to the evaporator as mentioned above, the conventional heat pump has a low defrosting efficiency. So as to achieve a successful defrosting operation, thus, the defrosting operation should be conducted for a relatively long period of time.

In the conventional heat pump, generally, the successful defrosting operation is conducted for 5-10 minutes or more, which is dependant upon the quantity of the accumulated frost. During the defrosting operation, the heating operation stops, which causes another problems that the indoor temperature becomes substantially low to an appropriate value and thus the heating operation inevitably starts again to maintain the appropriate indoor temperature at a state where the defrosting operation is not completely finished.

Therefore, the liquid-phase refrigerant that is accumulated in the lower tubes of the exterior heat exchanger 13 are not completely evaporated, and thus, the frost or ice generated on the outer surface of the lower tubes still remains thereon by a given quantity, while not fully removed therefrom.

If the incomplete defrosting operation is repeatedly conducted at the state where the frost still remains in the end of the lower tubes of the exterior heat exchanger 13, the frost becomes accumulated. As a result, the accumulated frost undesirably serves to block the tubes of the exterior heat exchanger 13, which closes the air-flowing passageway, thereby causing a state where heating is impossible.

Third, in the conventional heat pump having the hot gas bypass cycle as mentioned above, at the state where the liquid-phase refrigerant is kept accumulated in the lower tubes of the exterior heat exchanger 13, a difference of the quantity of a refrigerant is generated between the exterior heat exchanger 13 and the interior heat exchanger 12. At this state, if the defrosting operation is finished to return to the heating operation, the refrigerant in the exterior heat exchanger 13 flows at the liquid phase into the compressor 11, and therefore, the liquid compression occurs in the compressor 11, thereby making the compressor 11 easily have troubles.

DISCLOSURE OF INVENTION

Technical Problem

Accordingly, it is an object of the present invention to provide a high speed defrosting heat pump that is capable of bypassing hot gas up to a quantity of 100% during a defrosting operation, thereby enabling the defrosting operating at a high speed, and that is capable of greatly reducing a heating-stop period of time according to the defrosting operation

Technical Solution

According to the present invention, there is provided a high speed defrosting heat pump that supplies hot gas evenly over the entire tubes of the exterior heat exchanger 13 during the defrosting operation having a hot gas bypass defrosting cycle, thereby completely evaporating the liquid-phase refrigerant remaining in the interiors of the tubes of the exterior heat exchanger, and that keeps at appropriate temperature and pressure the hot gas flowing again from the compressor after heat-exchanged at the exterior heat exchanger.

Advantageous Effects

According to the present invention, under the above configuration, the hot gas is bypassed up to a quantity of 100% to the evaporator during the defrosting operation, while solving the conventional problem that the defrosting is carried out only at the lower portions of the evaporator due to the liquid refrigerant accumulated in the lower tubes of the evaporator during a heating operation.

As mentioned above, according to the present invention, during the defrosting operation the high-temperature and high-pressure hot gas is bypassed up to a quantity of 100% to evaporate the frost on the outer surface of the heat exchanger as well as the liquid-phase refrigerant remaining in the lower tubes, thereby causing high degrees of heat-exchanging and pressure dropping.

Therefore, after heat-exchanged with the heat exchanger, the hot gas flowing into the compressor 11 has relatively low temperature and pressure than it bypassed up to a quantity of 100% in the conventional practices, and as a result of a test defrosting operation, it is found that the low pressure of the got gas is stable in a range between 4 KPa and 6 KPa and the high pressure thereof is stable in a range between 10 KPa and 15 KPa.

Accordingly, the high speed defrosting heat pump of the present invention can greatly reduce the troubles of the compressor caused by the excessive load and high pressure impacts applied to the compressor when the hot gas is bypassed up to a quantity of 100% in the conventional practices.

Further, the high speed defrosting heat pump of the present invention can bypass the hot gas up to a quantity of 100% during the defrosting operation, such that as a sufficient quantity of heat is supplied to the exterior heat exchanger for a relatively short period of time, the frost formed on the outer surface of the exterior heat exchanger can be removed at a high speed.

As mentioned above, the hot gas is bypassed up to only a quantity of 20 to 30% in the conventional practices, which needs the defrosting operation for at least 5 to 10 minutes. However, according to the present invention, the defrosting operation is completely finished for just 30 to 100 seconds, such that the heating-stop time during the defrosting operation becomes short, thereby minimizing the decrease of the indoor temperature.

Additionally, according to the heat pump of the present invention having the hot gas bypass defrosting cycle, the liquid-phase refrigerant accumulated in the lower tubes of the exterior heat exchanger 13 can be completely removed during the defrosting operation, such that the difference of the quantity of a refrigerant between the exterior heat exchanger 13 and the interior heat exchanger 12 is not generated, and therefore, the present invention can overcome the conventional problem that the refrigerant of the exterior heat exchanger 13 flows at the liquid phase into the compressor 11 when the heating operation starts again after completing the defrosting operation, thereby effectively preventing the compressor 11 from being damaged.

Furthermore, according to the present invention the three-way valve is just adopted as a control valve for bypassing the hot gas, and when compared with the conventional practices where a plurality of control valves are used, in this case, the present invention can obtain the easiness of control and the reliability of a control operation, such that the heat pump device becomes simple in its configuration, the trouble causes of the device are reduced, and the maintenance of the device becomes easy.

*EXPLANATION ON THE REFERENCE NUMERALS ON THE MAIN PARTS IN THE DRAWING

| | |
|---|---|
| 11: | compressor |
| 12: | interior heat exchanger |
| 13: | exterior heat exchanger |
| 14, 15: | header for gas use only |
| 16: | distributor |
| 17, 18: | header for liquid use only |
| 21: | four-way valve |
| 22: | three-way valve |
| 23, 24: | expansion valve |
| 25, 26, 27, 28: | check valve |
| 31: | bypass pipe |
| 32, 33: | distribution tube |
| 41: | indoor unit blower |
| 42: | outdoor unit blower |
| 43: | liquid receiver |

Best Mode for Carrying Out the Invention

Now, an explanation on the configuration and operation of a high speed defrosting heat pump will be given with reference to FIGS. 2 and 3.

Figure 2:
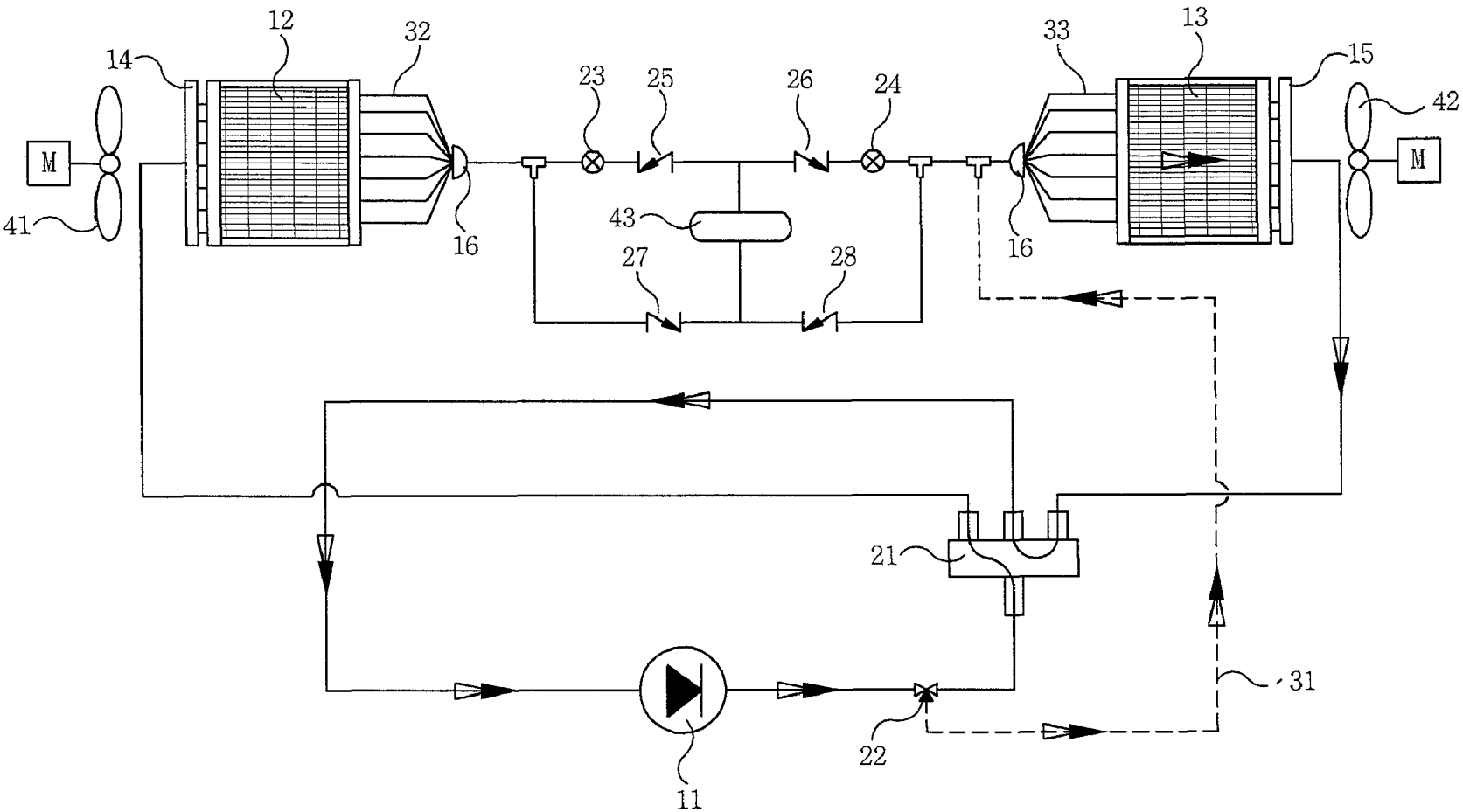
FIG. 2 is a view showing the state of a hot gas bypass defrosting operation in a high speed defrosting heat pump according to a first embodiment of the present invention.
Figure 3:
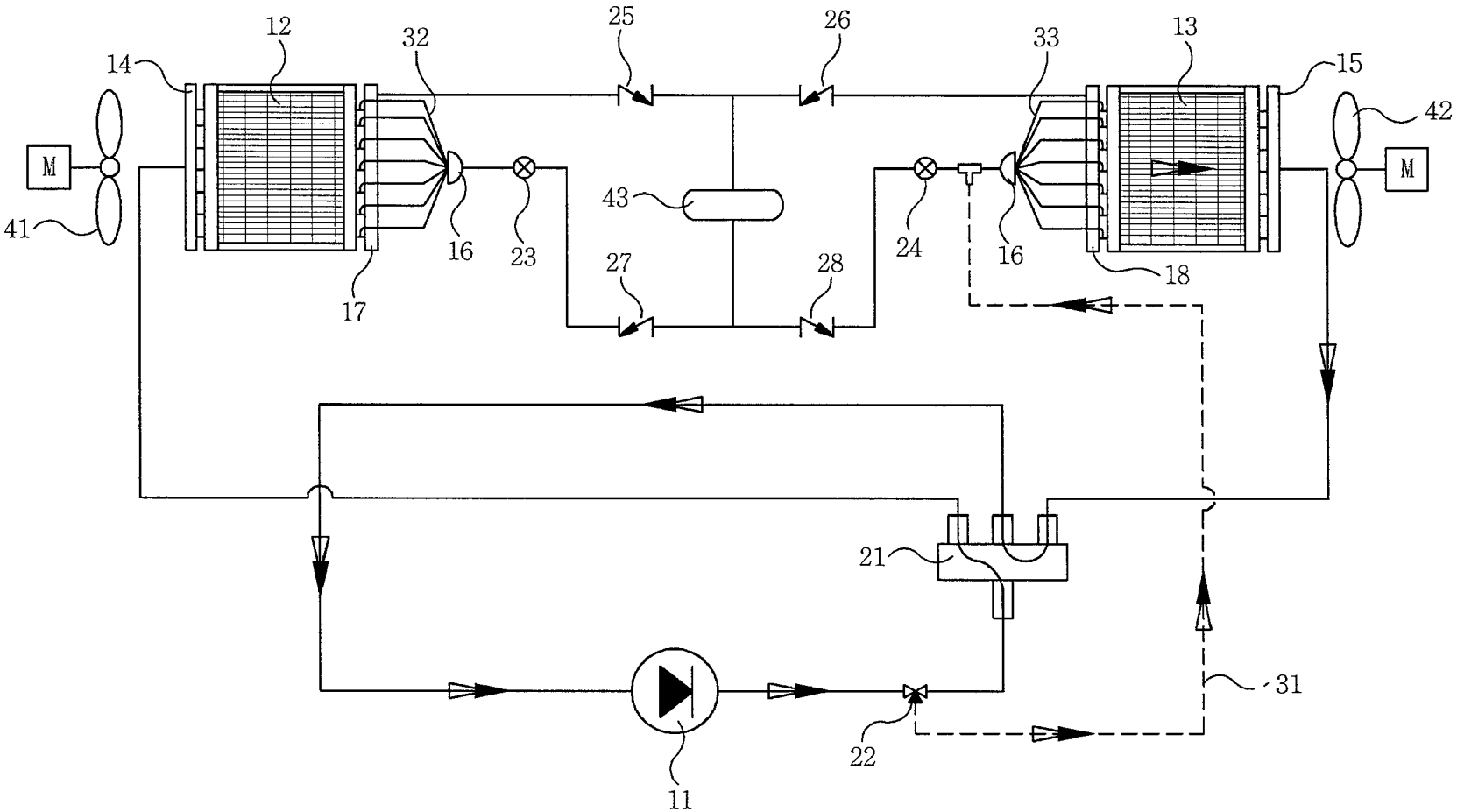
FIG. 3 is a view showing the state of a hot gas bypass defrosting operation in a high speed defrosting heat pump according to a second embodiment of the present invention.

FIG. 2 is a view showing the state of a hot gas bypass defrosting operation in the high speed defrosting heat pump according to a first embodiment of the present invention, and FIG. 3 is a view showing the state of a hot gas bypass defrosting operation in the high speed defrosting heat pump according to a second embodiment of the present invention.

As appreciated from the first and second embodiments of the present invention, the high speed defrosting heat pump includes a closed loop formed by a compressor 11 adapted to compress a refrigerant to high temperature and high pressure, an interior heat exchanger 12 adapted to condense the high-temperature and high-pressure refrigerant discharged from the compressor 11 to a liquid phase by radiation at the indoor, expansion valves 23 and 24 adapted to expand the liquid-phase refrigerant discharged from the interior heat exchanger 12 to a low pressure by means of a throttling action, and an exterior heat exchanger 13 adapted to evaporate the throttled refrigerant to a gaseous phase by means of the heat absorption at the outdoor. In this case, a four-way valve 21 is mounted between the compressor 11 and the interior heat exchanger 12, and further, the heat pump includes a liquid receiver 43, an indoor unit blower 41, and an outdoor unit blower 42 mounted therein.

Especially, in constructing the hot gas bypass defrosting cycle of the heat pump, only a three-way valve 22 is disposed on a refrigerant pipe between the compressor 11 and the four-way valve 21, and a bypass pipe 31 is branched off from the three-way valve 22 in such a manner as to be connected between the expansion valve 24 and the exterior heat exchanger 13.

Figure 1:
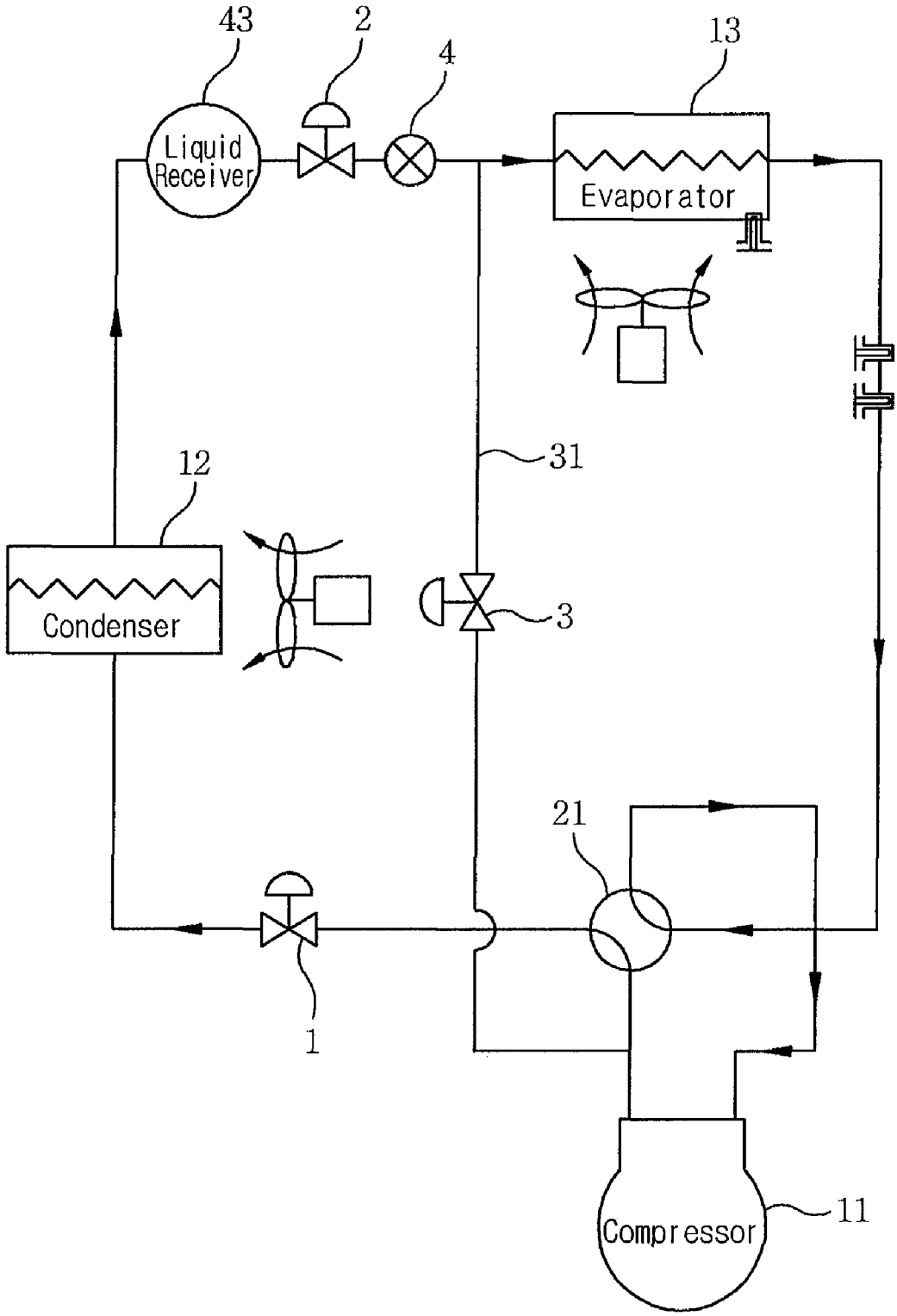
FIG. 1 is a view showing a conventional hot gas bypass defrosting operation.

According to the present invention, therefore, if only the three-way valve 22 is controlled, the hot gas is bypassed to freely switch the defrosting operation and the heating operation, but according to the conventional heat pump as shown in FIG. 1, as the control valves 1 and 2 and the hot gas control valve 3 are disposed on the refrigerant pipe and the bypass pipe connecting from the compressor to the condenser, the three valves should be opened and closed in a crossing relation with each other so as to bypass the hot gas. Therefore, when compared with the conventional heat pump, the heat pump of the present invention can greatly improve the easiness of the control manipulation and the reliability of the control.

Next, an explanation on the features of the configuration of the heat pump according to the first embodiment of the present invention will be given.

According to the first embodiment of the present invention, a pair of distributors 16 are disposed correspondingly between the interior heat exchanger 12 and the expansion valve 23 and between the exterior heat exchanger 13 and the expansion valve 24.

The pair of distributors 16 have a plurality of distribution tubes 32 and 33 branched there from, each of the distribution tubes 32 and 33 being connected to the end portion of each heat-exchanging tube of the heat exchangers, and a refrigerant pipe is connected to the opposite side to the branched distribution tubes 32 and 33 of the pair of distributors 16, such that the pair of distributors 16 are connected with each other by means of the refrigerant pipe.

At this time, on the refrigerant pipe interconnecting the pair of distributors 16 are disposed one by one the expansion valves 23 and 24 and a pair of check valves 25 and 26.

The refrigerant pipe interconnecting the pair of distributors 16 is branched off between the distributor 16 and the expansion valve 23 and between the distributor 16 and the expansion valve 24, and a pair of check valves 27 and 28 are disposed in a facing direction with each other on the branched refrigerant pipes in such a manner as to be connected to each other.

Further, the refrigerant pipes are branched off again between the check valve 27 and the check valve 28 and between the check valve 25 and the check valve 26 in such a manner as to be connected to the liquid receiver 43.

FIG. 3 shows the high speed defrosting heat pump according the second embodiment of the present invention, which is most preferable, and the heat pump of the present invention has the following characteristics in its configuration.

In the second embodiment of the present invention, headers 14 and 15 for gas use only and headers 17 and 18 for liquid use only are disposed at the refrigerant inlets and outlets of the interior heat exchanger 12 and the exterior heat exchanger 13, and the header 17 for liquid use only at the refrigerant outlet side of the interior heat exchanger 12 is connected by means of a separate refrigerant pipe with the header 18 for liquid use only at the refrigerant inlet side of the exterior heat exchanger 13.

Check valves 25 and 26 are disposed on the refrigerant pipe interconnecting the headers 17 and 18 for liquid use only, thereby preventing the refrigerant from flowing directly between the header 17 for liquid use only at the refrigerant outlet side of the interior heat exchanger 12 and the header 18 for liquid use only at the refrigerant inlet side of the exterior heat exchanger 13.

In the same manner as in the first embodiment of the present invention, according to the second embodiment of the present invention, the pair of distributors 16 are disposed correspondingly between the interior heat exchanger 12 and the expansion valve 23 and between the exterior heat exchanger 13 and the expansion valve 24, and at this time, the plurality of distribution tubes 32 and 33 branched off from the pair of distributors 16 are not connected to the headers 17 and 18 for liquid use only, but connected to the end portions of the heat-exchanging tubes of the heat exchangers like the first embodiment of the present invention.

The branched distribution tubes 32 and 33 of the pair of distributors 16 are connected by means of a refrigerant pipe connected to the opposite side to the branched side thereof, and on the refrigerant pipe interconnecting the pair of distributors 16 are disposed one by one the expansion valves 23 and 24 and the pair of check valves 27 and 28.

Further, the refrigerant pipes are branched off again between the check valve 25 and the check valve 26 and between the check valve 27 and the check valve 28 in such a manner as to be connected to the liquid receiver 43.

Now, an explanation on the defrosting operation of the heat pump according to the first and second embodiments of the present invention will be given with reference to FIGS. 2 and 3.

First, an explanation on the refrigerant flow according to the first embodiment of the present invention as shown in FIG. 2 is given below in a case where frost is generated on the exterior heat exchanger 13 during the heating operation in winter.

The refrigerant that is in a state of high temperature and high pressure in the compressor 11 flow toward the interior heat exchanger 12 as a condenser via the four-way valve 21. Then, the refrigerant that flows to the heat-exchanging tubes of the interior heat exchanger 12 via the header 14 for gas use only at the inlet side of the interior heat exchanger 12 are heat-exchanged and condensed with indoor air at the heat-exchanging tubes.

The condensed refrigerant is conveyed through the distribution tubes 32 to the distributor 16 and after they are collected thereto, they are supplied toward the exterior heat exchanger 13 as the evaporator via the check valve 27, the liquid receiver 43, the check valve 26, and the exterior expansion valve 24.

The refrigerant that is supplied toward the exterior heat exchanger 13 are first sent to the distributor 16 and are then supplied into each of the plurality of distribution tubes 33. After that, since the plurality of distribution tubes 33 of the distributor 16 are connected correspondingly to the end portions of the heat-exchanging tubes of the exterior heat exchanger 13, the refrigerant is supplied evenly to the entire exterior heat exchanger 13.

The refrigerant that is heat-exchanged and evaporated with the outdoor air in the heat-exchanging tubes of the exterior heat exchanger 13 are outputted from the header 15 at the outlet side of the exterior heat exchanger 13 and are then supplied again to the compressor 11 via the four-way valve 21, thereby forming the closed loop of the heat pump.

In a case where the cooling operation is conducted by adjusting the four-way valve 21, referring to FIG. 2, the refrigerant discharged from the compressor 11 is collected to the distributor 16 through the exterior heat exchanger 13 as the condenser by means of the control of the four-way valve 21. After that, the refrigerant is distributed at the distributor 16 via the check valve 28, the liquid receiver 43, the check valve 25, and the interior expansion valve 23 and are supplied to the interior heat exchanger 12 as the evaporator. Then, the refrigerant is heat-exchanged and evaporated with the indoor air. After evaporated, the refrigerant is supplied toward the compressor 11, thereby forming the closed loop of the heat pump.

Next, an explanation on the defrosting operation through the hot gas bypass according to the present invention is given below in a case where frost is generated on the exterior heat exchanger 13 during the heating operation.

First, the three-way valve 22 that is disposed at the front side of the discharge outlet of the compressor 11 is switched to close the passageway of the refrigerant (hot gas) conveyed to the interior heat exchanger 12 and to open the passageway toward the bypass pipe 31. According to the present invention, at this time, the hot gas discharged from the compressor 11 can be sent up to a quantity of 100% to the bypass tube 31.

The discharged hot gas is supplied along the bypass tube 31 to the refrigerant pipe connected between the exterior expansion valve 24 and the distributor 16 of the exterior heat exchanger 13 and is then passed through the distributor 16, the distribution tubes 33, and the heat-exchanging tubes of the exterior heat exchanger 13. After that, the hot gas is sent to the compressor 11, thereby forming the closed loop of the heat pump.

At this time, the three-way valve 22 is closed toward the interior heat exchanger 12, such that the refrigerant is not circulated thereto, and therefore, the hot gas does not flow toward the interior heat exchanger 12.

According to the present invention, the hot gas does not flow to the exterior heat exchanger 13 along a single passageway and is supplied into each of the plurality of distribution tubes 33 via the distributor 16, such that the hot gas flows evenly into the upper and lower portions of the heat-exchanging tubes of the exterior heat exchanger 13.

Therefore, the present invention can solve the problems the conventional heat pump has had wherein the hot gas is contacted with the only upper portion of the liquid-phase refrigerant gathering in the lower tubes of the exterior heat exchanger 13 and it is not contacted with the lower portion of the refrigerant.

In other words, according to the present invention the hot gas is supplied directly to the lowermost tubes of the exterior heat exchanger 13 by using the distribution tubes 33 of the distributor 16, thereby evaporating the liquid-phase refrigerant remaining in the interior of the exterior heat exchanger 13, and therefore, the heat-exchanging is easily conducted through the heat-exchanging tubes on which frost is generated, thereby achieving the heat-exchanging action over the exterior heat exchanger 13 evenly and simultaneously.

During this process, according to the present invention even though the hot gas is bypassed up to a quantity of 100%, it is possible to conduct sufficient heat-exchanging with the remaining refrigerant, thereby lowering the hot gas to an appropriate temperature. Thus, the hot gas that is heat-exchanged at the exterior heat exchanger 13 becomes also lowered to an appropriate pressure.

A technique for controlling the passageway-switching of the three-way valve 22 for the defrosting operation adopts known technical systems. Generally, the defrosting operation is carried out for 30 to 100 seconds, and a heating operation starts again. In a case where frost is generated by an excessive quantity, the three-way valve 22 is switched continuously at intervals between 20 seconds and 30 seconds to conduct the heating operation.

In this case, as the heating operation stops for only 20 to 30 seconds, it is difficult for a user to recognize the stop of the heating operation at the indoor, thereby making the user feel that the heating operation is kept on.

According to the present invention, in a case where a quantity of frost is not much or the high speed defrosting is not needed, the hot gas is bypassed partially, not up to a quantity of 100%, by the control of the passageway opening degree of the three-way valve 22.

Next, an explanation on the refrigerant flow according to the second embodiment of the present invention as shown in FIG. 3 is given below in a case where frost is generated on the exterior heat exchanger 13 during the heating operation in winter.

The refrigerant that is in a state of high temperature and high pressure in the compressor 11 flow toward the interior heat exchanger 12 as a condenser via the four-way valve 21. Then, the refrigerant that flows to the heat-exchanging tubes of the interior heat exchanger 12 via the header 14 for gas use only at the inlet side of the interior heat exchanger 12 are heat-exchanged and condensed with indoor air at the heat-exchanging tubes.

The condensed refrigerant is conveyed through the header 17 for liquid use only of the interior heat exchanger 12 and are supplied toward the exterior heat exchanger 13 via the check valve 25, the liquid receiver 43, the check valve 28, and the exterior expansion valve 24.

The refrigerant that is supplied toward the exterior heat exchanger 13 are first sent to the distributor 16 and are then supplied into each of the plurality of distribution tubes 33. After that, the refrigerant is distributed to the heat-exchanging tubes of the exterior heat exchanger 13.

At this time, since the plurality of distribution tubes 33 are connected correspondingly to the end portions of the heat-exchanging tubes of the exterior heat exchanger 13, not through the header 18 for liquid use only, the refrigerant is supplied evenly to the entire exterior heat exchanger 13.

The refrigerant that is conveyed to the heat-exchanging tubes of the exterior heat exchanger 13 by means of the plurality of distribution tubes 33 of the distributor 16 are heat-exchanged and evaporated with the outdoor air and are then supplied again to the compressor 11, thereby forming the closed loop of the heat pump.

In a case where the cooling operation is conducted by adjusting the four-way valve 21, referring to FIG. 3, the refrigerant discharged from the compressor 11 is heat-exchanged and condensed with the outdoor air through the heat-exchanging tubes of the exterior heat exchanger 13 as the condenser by means of the control of the four-way valve 21, and after that, the refrigerant is passed through the header 18 for liquid use only of the exterior heat exchanger 13.

The refrigerant is distributed at the distributor 16 via the check valve 26, the liquid receiver 43, the check valve 27, and the interior expansion valve 23 and are supplied to the interior heat exchanger 12 as the evaporator. Then, the refrigerant is heat-exchanged with the indoor air and evaporated in the interior heat exchanger 12. After evaporated, the refrigerant is supplied toward the compressor 11, thereby forming the closed loop of the heat pump.

In a case where the defrosting operation is conducted according to the second embodiment of the present invention, as shown in FIG. 3, the three-way valve 22 is switched to bypass the hot gas in the same manner as in the first embodiment of the present invention.

According to the second embodiment of the present invention, the headers 17 and 18 for liquid use only are attached on the respective heat exchangers, serving to distribute and supply the refrigerant flowing into the heat exchangers via the expansion valves 23 and 24 during the cooling and heating operations and the hot gas supplied through the three-way valve 22 during the defrosting operation to the respective heat-exchanging tubes through the distribution tubes 32 and 33 of the respective distributors 16, and on the other hand, serving to convey the refrigerant flowing toward the expansion valves 23 and 24 from the respective heat exchangers through them.

In other words, in the second embodiment of the present invention, the refrigerant that flows toward the interior and exterior heat exchangers 12 and 13 via the expansion valves 23 and 24 are distributed evenly to the heat-exchanging tubes, and the refrigerant outputted from the interior and exterior heat exchangers 12 and 13 are directed just to the expansion valves 23 and 24, not passing through the small passageways of the distribution tubes 32 and 33.

In this case, if the refrigerant outputted from the interior and exterior heat exchangers 12 and 13 passes through the small passageways of the distribution tubes 32 and 33, passageway resistance may occur, and thus, so as to remove this problem, the refrigerant outputted from the interior and exterior heat exchangers 12 and 13 is directed just through the headers 17 and 18 for liquid use only, not passing through the distribution tubes 32 and 33.

According to the second embodiment of the present invention wherein the headers 17 and 18 for liquid use only are disposed, the passageway resistance becomes lower than that in the first embodiment of the present invention, such that the refrigerant-flowing becomes more smooth, thereby obtaining a high heat efficiency of the heat pump.

What is claimed is:

1. A high speed defrosting heat pump in which a refrigerant is circulated in a closed loop formed by a compressor (11), a four-way valve (21), an interior heat exchanger (12), expansion valves (23 and 24), and an exterior heat exchanger (13) so as to conduct cooling and heating operations by switching a refrigerant-circulating direction by means of the four-way valve (21), the high speed defrosting heat pump comprising:

a three-way valve (22) disposed on a refrigerant pipe connected between the compressor (11) and the four-way valve (21); and a bypass pipe (31) is branched off from the three-way valve (22) in such a manner as to be connected to a refrigerant pipe connected between the expansion valve (24) and the exterior heat exchanger (13), whereby hot gas discharged from the compressor (11) is introduced to the exterior heat exchanger via the bypass tube (31) under the control of the three-way valve (22).

2. The high speed defrosting heat pump according to claim 1, further comprising a pair of distributors (16) disposed correspondingly between the interior heat exchanger (12) and the expansion valve (23) and between the exterior heat exchanger (13) and the expansion valve (24), the pair of distributors (16) being coupled at one sides thereof to a refrigerant pipe so as to be connected to each other by means of the refrigerant pipe and being coupled at the other sides thereof to a plurality of distribution tubes (32 and 33), the plurality of distribution tubes (32 and 33) being connected correspondingly to the end portions of heat-exchanging tubes of the interior heat exchanger (12) and the exterior heat exchanger (13).

3. The high speed defrosting heat pump according to claim 2, wherein the expansion valves (23 and 24) and a pair of check valves (25 and 26) are disposed on the refrigerant pipe interconnecting the pair of distributors (16), the refrigerant pipe interconnecting the pair of distributors 16 being branched off between the distributors (16) and the expansion valves (23 and 24), and a pair of check valves (27 and 28) are disposed on the branched refrigerant pipe in such a manner as to be connected to each other, the refrigerant pipe being branched off again between the check valve (27) and the check valve (28) and between the check valve (25) and the check valve (26) so as to be connected to a liquid receiver (43).

4. The high speed defrosting heat pump according to claim 2, further comprising headers (14 and 15) for gas use only and headers (17 and 18) for liquid use only disposed at the refrigerant inlets and outlets of the interior heat exchanger (12) and the exterior heat exchanger (13), respectively, wherein the header (17) for liquid use only at the refrigerant outlet side of the interior heat exchanger (12) is connected with the header (18) for liquid use only at the refrigerant inlet side of the exterior heat exchanger 13 by means of a separate refrigerant pipe, and the check valves (25 and 26) are disposed on the refrigerant pipe interconnecting the headers (17 and 18) for liquid use only, such that the refrigerant is prevented from flowing directly between the header (17) for liquid use only at the refrigerant outlet side of the interior heat exchanger (12) and the header (18) for liquid use only at the refrigerant inlet side of the exterior heat exchanger (13).

5. The high speed defrosting heat pump according to claim 4, wherein the plurality of distribution tubes (32 and 33) branched off from the pair of distributors (16) disposed correspondingly between the interior heat exchanger (12) and the expansion valve (23) and between the exterior heat exchanger (13) and the expansion valve (24) are connected to the end portions of the heat-exchanging tubes of the interior heat exchanger (12) and the exterior heat exchanger (13) instead of the headers (17 and 18) for liquid use only.

6. The high speed defrosting heat pump according to claim 5, wherein the pair of distributors (16) are connected to the refrigerant pipe having the expansion valves (23 and 24) and the check valves (27 and 28) coupled thereon in the opposite sides to the branched sides of the distribution tubes (32 and 33), the refrigerant pipes connected between the check valve (27) and the check valve (28) and between the check valve (25) and the check valve (26) being branched off again in such a manner as to be connected to the liquid receiver (43).

* * * * *